US007731181B2

(12) United States Patent
Chang

(10) Patent No.: US 7,731,181 B2
(45) Date of Patent: Jun. 8, 2010

(54) PAPER FEEDING APPARATUS WITH PAPER SIZE DETERMINING MEANS

(75) Inventor: Yuing Chang, Hsinchu (TW)

(73) Assignee: Avision Inc. (TW)

( * ) Notice: Subject to any disclaimer, the term of this patent is extended or adjusted under 35 U.S.C. 154(b) by 89 days.

(21) Appl. No.: 11/898,308

(22) Filed: Sep. 11, 2007

(65) Prior Publication Data

US 2008/0128976 A1 Jun. 5, 2008

(30) Foreign Application Priority Data

Dec. 1, 2006 (CN) ..... 2006 1 0118969

(51) Int. Cl.
*B65H 1/00* (2006.01)

(52) U.S. Cl. ..... 271/171; 399/389; 399/393

(58) Field of Classification Search ..... 271/171; 399/389, 393

See application file for complete search history.

(56) References Cited

U.S. PATENT DOCUMENTS 4,657,239 A * 4/1987 Ikesue et al. ..... 271/227
5,014,091 A * 5/1991 Koike et al. ..... 399/405
5,165,675 A * 11/1992 Kanaya ..... 271/3.03
5,195,734 A * 3/1993 Tanabe ..... 271/9.03
5,327,206 A * 7/1994 Ueda et al. ..... 399/402
6,073,925 A * 6/2000 Sato ..... 271/171
6,315,285 B1 * 11/2001 Brugger et al. ..... 271/145
7,413,188 B2 * 8/2008 Miki ..... 271/171
7,510,181 B2 * 3/2009 Kozaki ..... 271/171
7,516,955 B2 * 4/2009 Yamagishi ..... 271/171
2005/0133983 A1 * 6/2005 Jacobs et al. ..... 271/145
2006/0087073 A1 * 4/2006 Yamagishi ..... 271/171
2006/0255532 A1 * 11/2006 Tsai ..... 271/171
2009/0051101 A1 * 2/2009 Yamagishi ..... 271/171
2009/0066011 A1 * 3/2009 Ohno et al. ..... 271/171

* cited by examiner

*Primary Examiner*—Patrick Mackey
*Assistant Examiner*—Prasad V Gokhale

(57) ABSTRACT

A paper feeding apparatus with a paper size determining means includes a paper tray, paper guide, a belt, a roller set, a sensing mechanism and a control unit. The paper tray has a front surface for supporting paper and a rear surface. The paper guide is movably disposed on the paper tray and for abutting against an edge of the paper in the paper tray. The roller set is rotatably disposed on the rear surface. The belt, connected to the paper guide and wound around the roller set, synchronously moves the paper guide and rotates the roller set. The sensing mechanism disposed on the rear surface senses a to-be-sensed component disposed on the belt or the roller set and thus outputs a sensing signal. The control unit receives the sensing signal and thus determines size of the paper.

7 Claims, 5 Drawing Sheets

PAPER FEEDING APPARATUS WITH PAPER SIZE DETERMINING MEANS

This application claims the benefit of The People's Republic of China application Serial No. 200610118969.4, filed Dec. 1, 2006, the subject matter of which is incorporated herein by reference.

BACKGROUND OF THE INVENTION

1. Field of the Invention

The invention relates in general to a paper feeding apparatus with a paper size determining means, and more particularly to a paper feeding apparatus detecting paper size by using a to-be-sensed component synchronously moved with a paper guide.

2. Description of the Related Art

Each of a copier, a scanner, a printer and a multi-function peripheral is an electronic product needing a document specification detecting device. So, it is very important to select a suitable document specification detecting device for these electronic products.

FIG. 1 (Prior Art) is a schematic illustration showing a rear surface of a paper tray of a conventional copier. Referring to FIG. 1, the conventional paper tray 100 includes a blade-like plate 110. The blade-like plate 110 contains a fulcrum 120, a section track 130, protrusions 140 and a paper guide 150 movable on the section track 130. When the paper guide 150 slides along the section track 130 and abuts against an edge of the paper, the blade-like plate 110 is rotated about the fulcrum 120. The protrusions 140 having different sizes respectively correspond to different paper sizes. When the paper guide 150 abuts against the edge of the paper, the protrusion 140 corresponding to the size of the paper being used shields a sensing path of a photosensor 115. The size of the paper may be judged according to the size of the range of the sensing path being shielded.

At present, the blade-like plate 110 is manufactured by way of injection molding or sheet metal pressing. These methods have the following drawbacks.

First, the blade-like plate formed by way of injection molding has the drawbacks of the poor rigidity, the contraction and the buckle.

Second, the blade-like plate formed by way of sheet metal pressing has the problems of the burr and the heavy weight.

In addition, the conventional paper feeding apparatus capable of detecting the paper size has the section track 130 having a lot of positions and angles corresponding to the paper with different paper sizes. So, when the paper size is rapidly switched, the paper guide cannot slide smoothly in the section track 130. In addition, the exterior of the blade-like plate 110 is like a long blade, and the swinging area of the blade-like plate 110 is large. Thus, the rear portion of the paper feeding apparatus needs a larger area coverage, thereby causing the bulkiness in the overall assembly.

SUMMARY OF THE INVENTION

The invention is directed to a paper feeding apparatus with a paper size determining means, getting rid of the conventional problem of bulkiness in manufacturing and assembling the device, effectively providing a more laborsaving function, and obtaining the more easily assembled property.

According to a first aspect of the present invention, a paper feeding apparatus with a paper size determining means is provided. The paper feeding apparatus includes a paper tray, a paper guide, a belt, a roller set, a sensing mechanism and a control unit. The paper tray has a front surface for supporting paper and a rear surface. The paper guide movably disposed on the paper tray is for abutting against an edge of the paper. The roller set is rotatably disposed on the rear surface. The belt is connected to the paper guide and wound around the roller set. The belt and the paper guide are synchronously moved to rotate the roller set. At least one of the belt and the roller set has at least one to-be-sensed component. The to-be-sensed component moves with the belt or the roller set synchronously. The sensing mechanism, disposed on the rear surface of the paper tray, is for sensing the to-be-sensed component and thus outputting a sensing signal. The control unit is for receiving the sensing signal and determining the paper size according to the sensing signal.

According to a second aspect of the present invention, a paper feeding apparatus with a paper size determining means is provided. The paper feeding apparatus includes a paper tray, a paper guide, a link mechanism, a sensing mechanism and a control unit. The paper tray has a front surface for supporting paper, and a rear surface on the opposite side of the paper tray. The paper guide movably disposed on the paper tray is for abutting against an edge of the paper. The link mechanism is disposed on the rear surface, connected to the paper guide and driven by the paper guide. The sensing mechanism disposed on the rear surface is for detecting a swinging state of the link mechanism and thus outputting a sensing signal when the paper guide abuts against the edge of the paper. The control unit is for receiving the sensing signal and thus determining the paper size.

The invention will become apparent from the following detailed description of the preferred but non-limiting embodiments. The following description is made with reference to the accompanying drawings.

DETAILED DESCRIPTION OF THE INVENTION

First Embodiment

Figure 1:
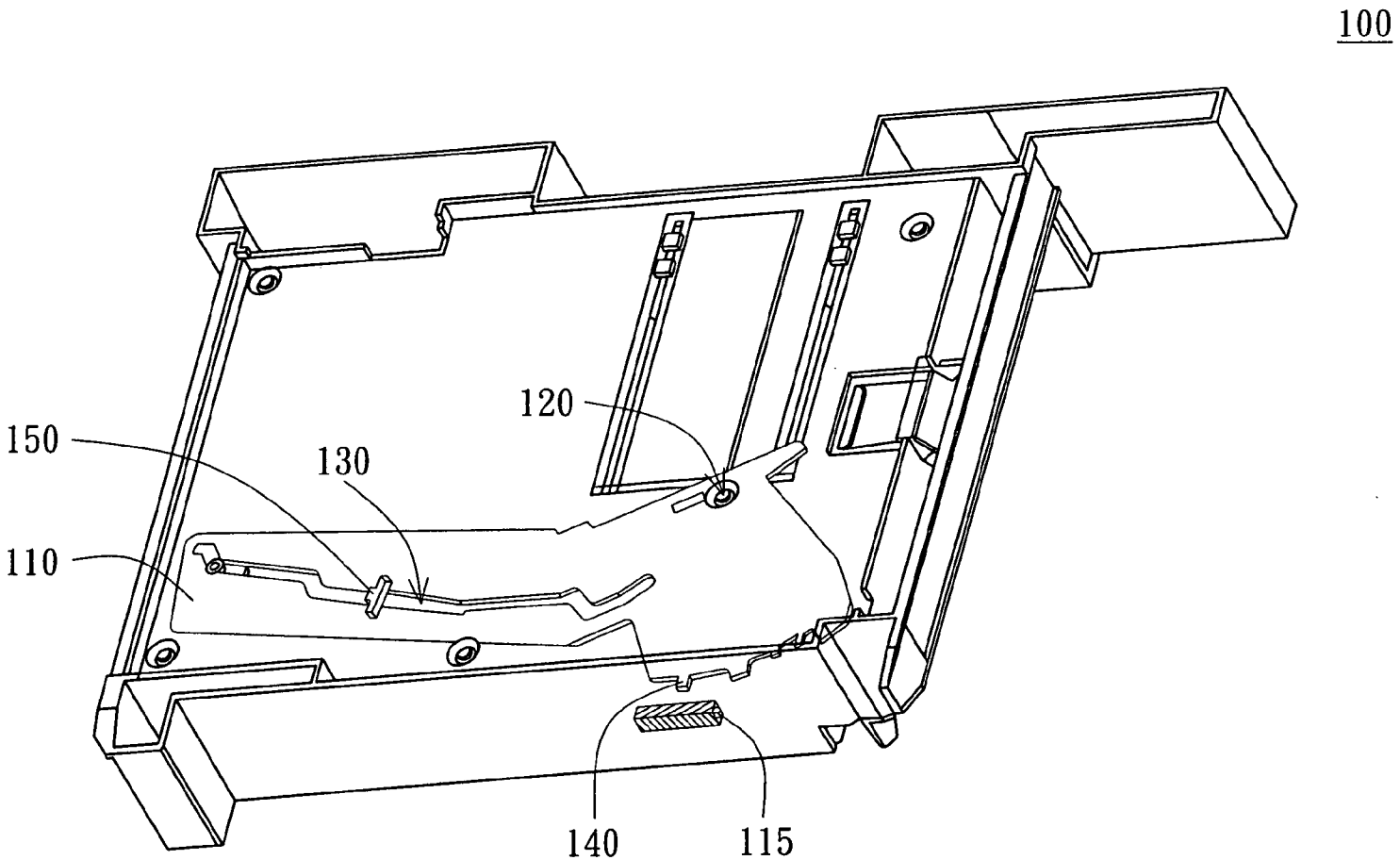
FIG. 1(PRIOR ART)
FIG. 1 (Prior Art) is a schematic illustration showing a rear surface of a paper tray of a conventional copier.
Figure 2A:
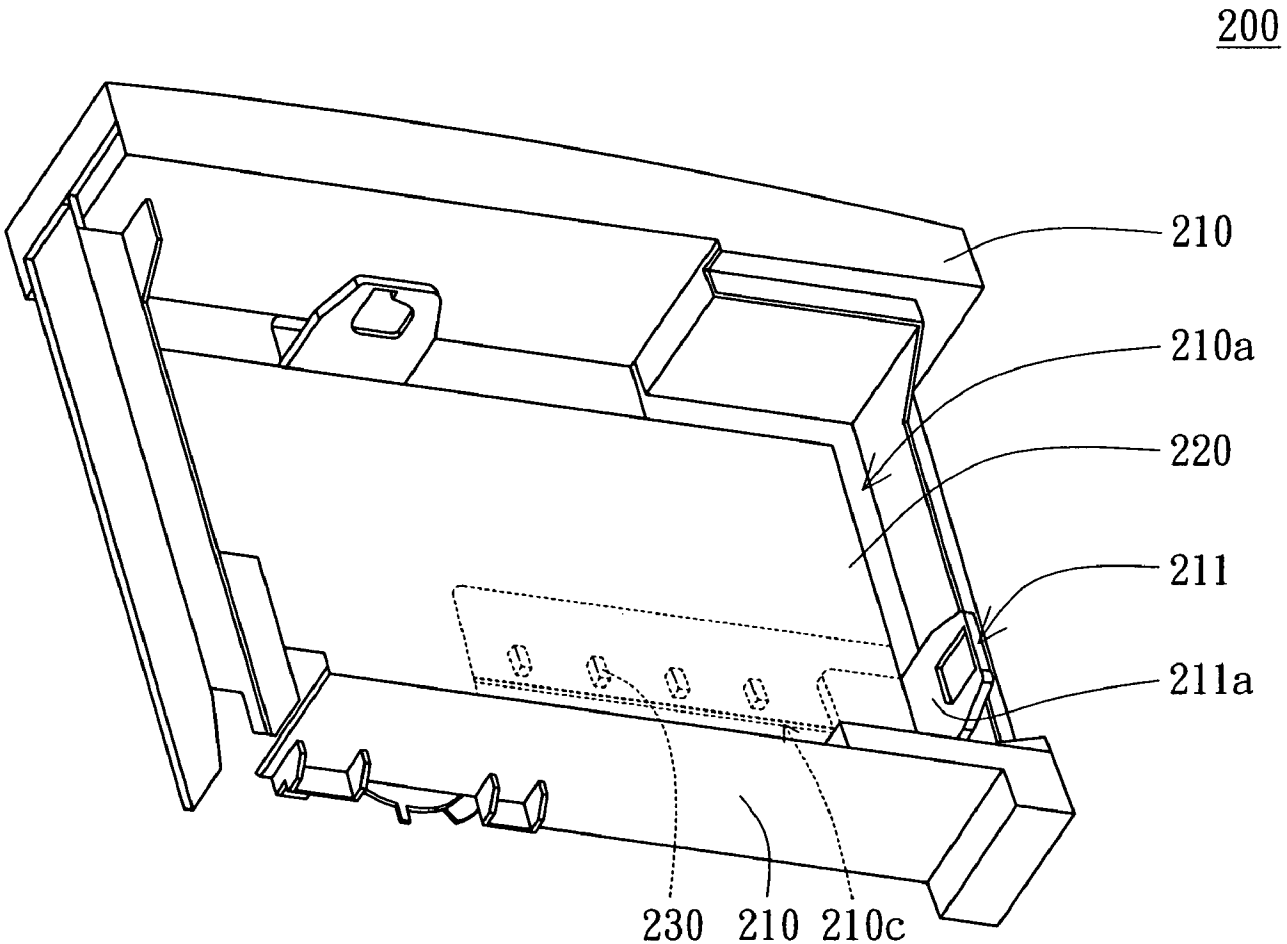
FIG. 2A is a schematic top view showing a paper feeding apparatus with a paper size determining means according to a first embodiment of the invention.
Figure 2B:
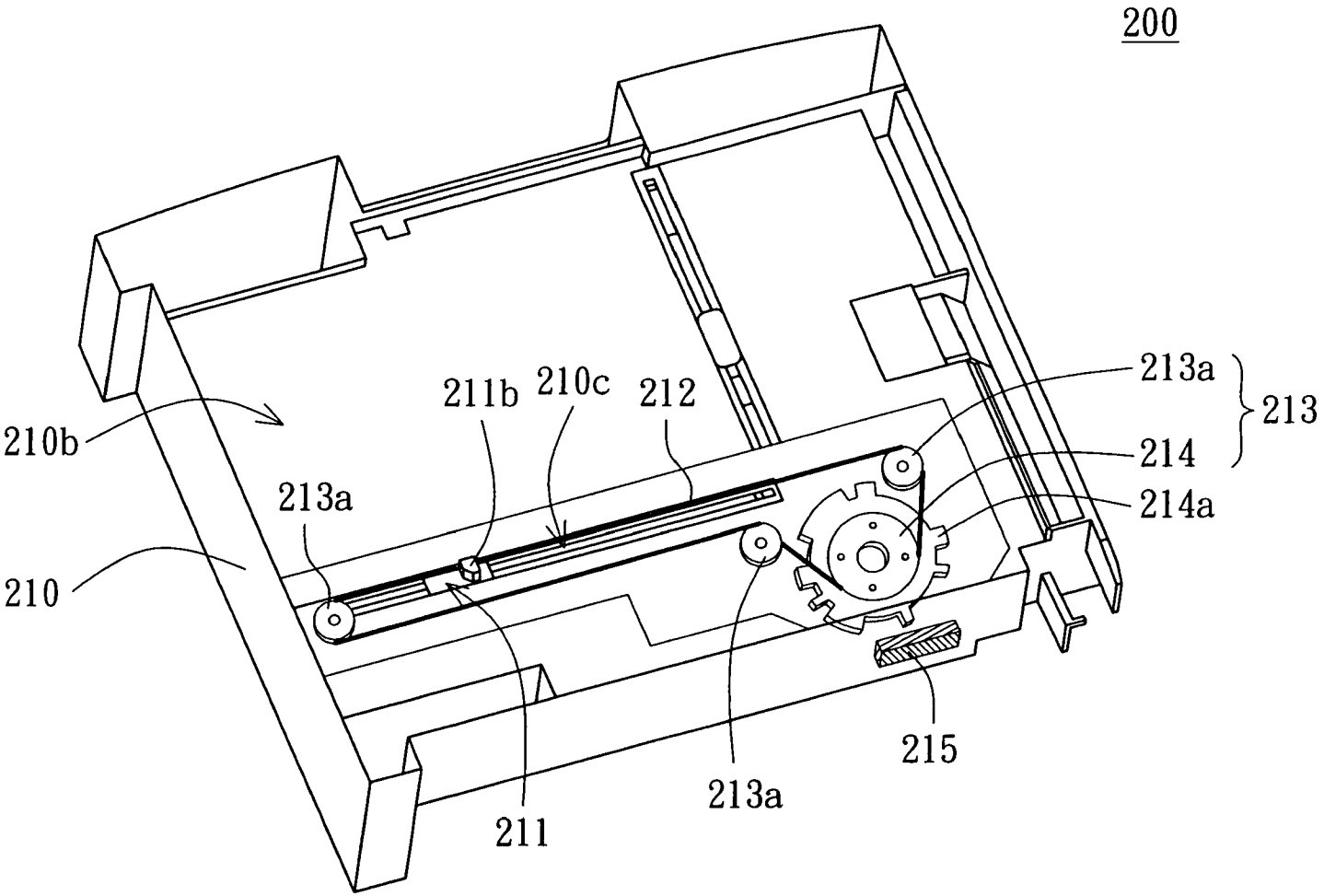
FIG. 2B is a schematic bottom view showing the paper feeding apparatus capable of detecting the paper size according to the first embodiment of the invention.
Figure 2C:
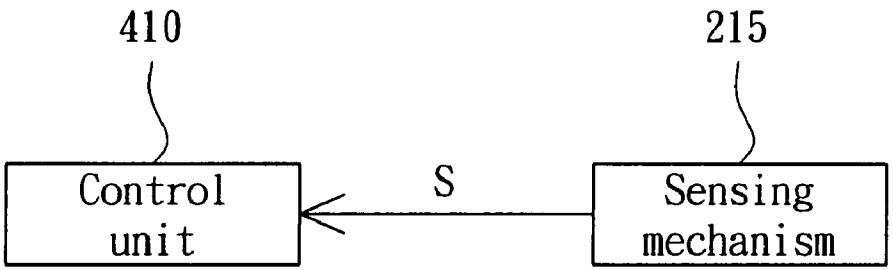
FIG. 2C is a block diagram showing a control unit and a sensing mechanism in the paper feeding apparatus according to the first embodiment of the invention.

FIG. 2A is a schematic top view showing a paper feeding apparatus with a paper size determining means according to a first embodiment of the invention. FIG. 2B is a schematic bottom view showing the paper feeding apparatus capable of detecting the paper size according to the first embodiment of the invention. FIG. 2C is a block diagram showing a control unit and a sensing mechanism in the paper feeding apparatus according to the first embodiment of the invention. Referring to FIGS. 2A to 2C, a paper feeding apparatus 200 capable of detecting the paper size includes a paper tray 210, a paper guide 211, a belt 212, a roller set 213, a sensing mechanism 215 and a control unit 410. The paper tray 210 has a front surface 210*a* and a rear surface 210*b*. The front surface 210*a* is for supporting paper 220. The paper guide 211 is movably disposed along an opening formed on the paper tray 210 and is for abutting against an edge of the paper 220. The belt 212 is disposed on the rear surface 210*b* and connected to the paper guide 211 and synchronously moved with the paper guide 211. The roller set 213 disposed on the rear surface 210*b* is coupled to the belt 212 and driven by the belt 212. The sensing mechanism 215 is disposed on the rear surface 210*b*, and senses the belt 212 or the roller set 213 when the paper guide 211 abuts against the edge of the paper 220 and thus outputs a sensing signal S. The control unit 410 electrically connected to the sensing mechanism 215 is for receiving the sensing signal S and thus determining the size of the paper 220. The belt 212, the roller set 213 and how the sensing mechanism 215 senses the roller set 213 will be described hereinafter according to the following example.

In this embodiment, the paper guide 211 includes a front portion 211*a* and a rear portion 211*b*. The front portion 211*a* projecting over the front surface 210*a* is for abutting against the edge of the paper 220. The rear portion 211*b* projecting over the rear surface 210*b* is connected to the belt 212 and synchronously moved with the belt 212. The rear portion 211*b* and the front portion 211*a* are connected to each other and pass through the paper tray 210, and the paper guide 211 may be moved back and forth along a sliding slot 210*c* of the paper tray 210. In addition, the paper feeding apparatus 200 capable of detecting the paper size further includes a positioning structure 230, disposed on the front surface 210*a*, for positioning the paper guide 211.

The belt 212 is wound around the roller set 213, and the paper guide 211 and the belt 212 are synchronously moved to drive the roller set 213 to rotate. The roller set 213 includes several rollers 213*a* and one wheel 214. The circumference of the wheel 214 is formed with several to-be-sensed components 214*a* having different lengths or profile sizes. The components 214*a* having different exterior features respectively represent different paper sizes.

Figure 3:
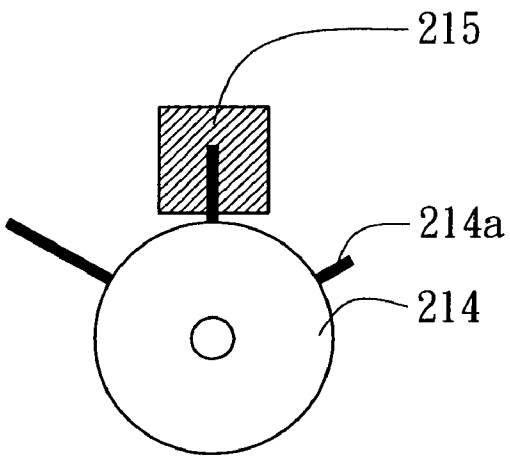
FIG. 3 is another schematic illustration showing a wheel of the invention.

In this embodiment, as shown in FIG. 2B, the components 214*a* are protrusions having different profile sizes. However, it is to be noted that the technology of this embodiment is not limited thereto. FIG. 3 is another schematic illustration showing a wheel of the invention. In FIG. 3, the components 214*a* of the wheel 214 are iron wires having different lengths.

When the paper guide 211 is moved toward the edge of the paper 220, the paper guide 211 drives the belt 212 to rotate the roller set 213 and the wheel 214.

When the paper guide 211 abuts against the edge of the paper 220, the sensing mechanism 215 senses the range of the sensing path shielded by the component 214*a* and thus outputs the sensing signal S to the control unit 410. At this time, the paper guide 211 may be fixed on the paper tray 210 through the positioning structure 230.

It is to be noted that the paper guide 211 being moved can drive one component 214*a*, which is sensed by the sensing mechanism 215 as the paper guide 211 is being moved. The component 214*a* may be rotated or moved and may have any shape in this embodiment.

One of ordinary skill in the art may easily understand that the technology of this embodiment is not limited thereto. For example, the roller set 213 only includes several rollers 213*a*, and the belt 212 further has one to-be-sensed component 214*a* synchronously moved with the belt 212. The sensing mechanism 215 may comprise several phototransistors disposed on the rear surface 210*b*, and the phototransistors are located on the moving path of the component 214*a*. The sensing mechanism could be a photo-interrupter.

When the paper guide 211 is moved toward the edge of the paper 220, the paper guide 211 drives the belt 212 and the component 214*a* to rotate the rollers 213*a*.

When the paper guide 211 abuts against the edge of the paper 220, the component 214*a* is moved to the optical signal transmitting path of the phototransistors, and the components 214*a* shield a portion of the optical signal transmitting path or the overall optical signal transmitting path according to the positions or exterior features thereof. Thus, the phototransistors only receive a portion of the optical signal or cannot receive any optical signal, and the phototransistors output the sensing signal S to the control unit 410 according to the received optical signal. Thus, the control unit 410 judges the size of the paper according to the sensing signal S.

Second Embodiment

Figure 4:
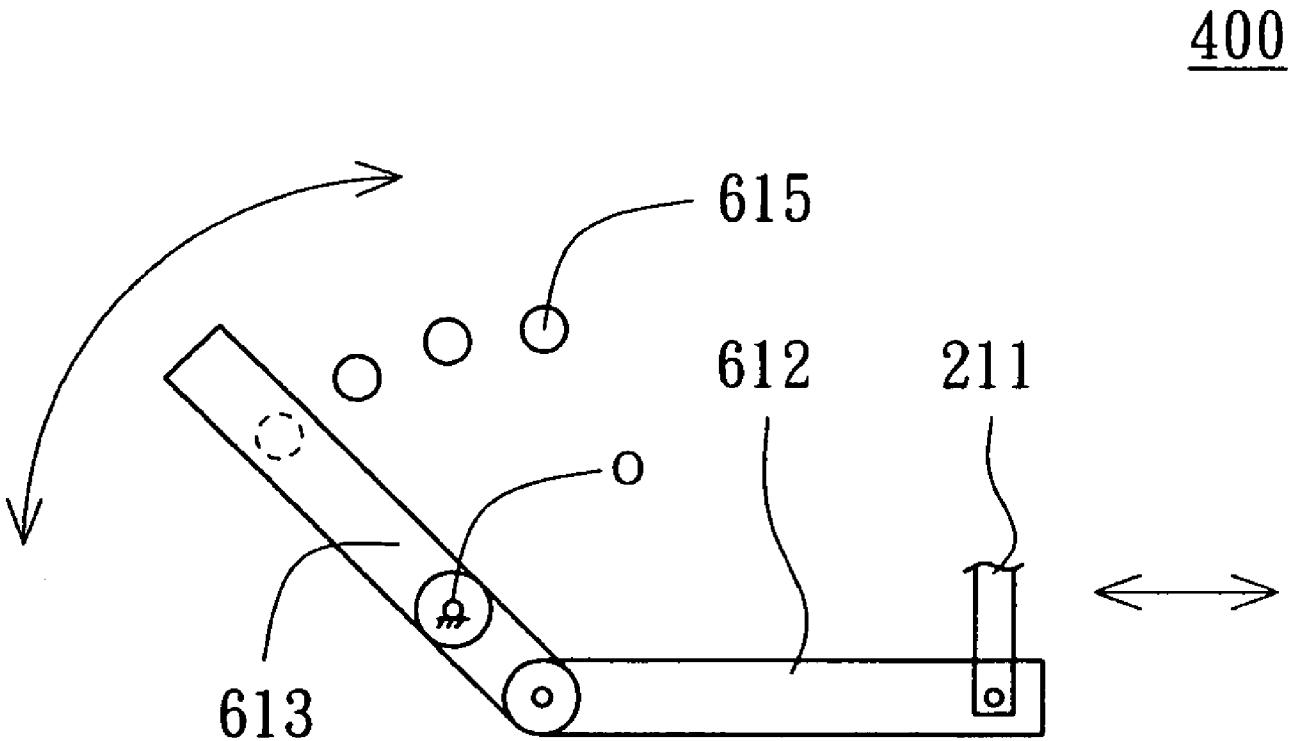
FIG. 4 is a partially schematic illustration showing a paper feeding apparatus with a paper size determining means according to a second embodiment of the invention.

FIG. 4 is a partially schematic illustration showing a paper feeding apparatus with a paper size determining means according to a second embodiment of the invention. As shown in FIG. 4, a paper feeding apparatus 400 of this embodiment differs from the paper feeding apparatus 200 of the first embodiment in that the mechanism connected to the paper guide 211 and thus synchronously moved with the paper guide 211 is a link mechanism including a first link 612 and a second link 613. The first link 612 and the second link 613 are disposed on the rear surface 210*b* of FIG. 2B and connected to the paper guide 211 of FIG. 2B. When the paper guide 211 abuts against the edge of the paper 220, a sensing mechanism 615 senses the swinging state of this link mechanism and thus outputs a sensing signal to the control unit. Then, the control unit judges the size of the paper according to the sensing signal.

A first end of the first link 612 is connected to the paper guide 211. A second end of the first link 612 is pivoted on a first end of the second link 613. A second end of the second link 613 swings about a shaft O relative to the first end of the second link 613.

When the paper guide 211 is moved toward the edge of the paper 220, the paper guide 211 moves the first link 612 to make the second end of the second link 613 swing.

When the paper guide 211 abuts against the edge of the paper 220, the sensing mechanism 615 outputs the sensing signal to the control unit according to the position wherein the second end of the second link 613 shields the sensing mechanism 615. Then, the control unit determines the size of the paper according to the sensing signal. The sensing mechanism 615 contains multiple phototransistors disposed on the rear surface 210*b* and on the swinging path of the second link 613, and is for receiving the optical signal. The sensing mechanism may be a photo-interrupter. The second link 613 is indirectly driven by the paper guide 211 to shield one of the phototransistors to disable the phototransistors from receiving the optical signal. Then, the phototransistors output the sensing signal to the control unit according to the received optical signal, and the control unit judges the size of the paper according to the sensing signal.

However, one of ordinary skill in the art may also understand that the technology of this embodiment is not limited thereto. For example, the first link 612 and the second link 613 may be respectively replaced with a chain and a sprocket, a gear and a rack or a first rack and a second rack.

The paper feeding apparatus capable of detecting the paper size according to each embodiment of the invention has the following advantages.

First, the combination of the existing members replaces the conventional one-piece molded blade-like plate, which has to be manufactured specially. Thus, the technological difficulty in manufacturing the product can be eliminated.

Second, the combination of the existing members can be designed into a more laborsaving mechanism according to the principle of lever, and can get rid of the multi-stage track positions and angles caused by the conventional track in response to different paper sizes. Thus, when the paper size is switched rapidly, the paper guide can slide in the section track smoothly.

Third, the paper feeding apparatus of the invention does not encounter the conventional problem of the too-large swinging area of the blade-like plate, and the paper feeding apparatus may be assembled in more convenient and easier manner.

While the invention has been described by way of example and in terms of preferred embodiments, it is to be understood that the invention is not limited thereto. On the contrary, it is intended to cover various modifications and similar arrangements and procedures. The scope of the appended claims therefore should be accorded the broadest interpretation so as to encompass all such modifications and similar arrangements and procedures.

What is claimed is:

1. A paper feeding apparatus, comprising:

a paper tray having a front surface for supporting paper and a rear surface;

a paper guide, disposed on the paper tray and being movable, for abutting against an edge of the paper;

a roller set disposed on the rear surface and being rotatable, wherein the roller set comprises a wheel, a plurality of rollers, and a plurality of to-be-sensed components of different sizes are attached to a circumference of the wheel;

a belt connected to the paper guide and wound around the roller set, wherein the belt and the paper guide move synchronously to rotate the wheel and the rollers, and the to-be-sensed components move with wheel synchronously;

a sensing mechanism, disposed on the rear surface of the paper tray, for sensing the to-be-sensed components and thus outputting a sensing signal; and a control unit for receiving the sensing signal and determining size of the paper according to the sensing signal;

when the paper guide moves toward the edge of the paper, the paper guide drives the belt to rotate the rollers and the wheel; and when the paper guide abuts against the edge of the paper, the sensing mechanism senses the to-be-sensed components and thus outputs the sensing signal to the control unit.

2. The apparatus according to claim 1, wherein the to-be-sensed components are protrusions of different sizes.

3. The apparatus according to claim 1, wherein the to-be-sensed components comprise iron wires.

4. The apparatus according to claim 1, wherein the sensing mechanism comprises a phototransistor for receiving an optical signal, and the sensing mechanism outputs the sensing signal to the control unit according to the optical signal received by the phototransistor.

5. The apparatus according to claim 1, wherein the sensing mechanism is a photo-interrupter.

6. The apparatus according to claim 1, wherein the paper guide, movable along an opening formed on the paper tray, comprises:

a front portion, projected over the front surface, for abutting against the edge of the paper; and a rear portion, projected over the rear surface, for connecting to the belt.

7. The apparatus according to claim 1, further comprising:

a positioning structure, disposed on the front surface, for positioning the paper guide.

* * * * *